United States Patent [19]

Fry, Jr.

[11] 4,151,233

[45] Apr. 24, 1979

[54] METHOD FOR PREPARING A SMOKE AGENT

[75] Inventor: Raymond R. Fry, Jr., Joppa, Md.

[73] Assignee: The United States of America as represented by the Secretary of the Army, Washington, D.C.

[21] Appl. No.: 843,390

[22] Filed: Oct. 19, 1977

[51] Int. Cl.[2] ..... C06B 21/00; C06B 39/00

[52] U.S. Cl. ..... 264/3 B; 149/19.9; 149/19.91; 149/19.92; 149/29

[58] Field of Search ..... 149/29, 19.9, 19.91, 149/19.92; 264/3 B

[56] References Cited

U.S. PATENT DOCUMENTS

| | | | |
|---|---|---|---|
| 2,574,466 | 11/1951 | Clay et al. | 149/29 |
| 3,488,711 | 1/1970 | Dany et al. | 149/29 |
| 3,650,855 | 3/1972 | MacKenzie | 149/19.9 |
| 3,650,856 | 3/1972 | Artz | 149/19.9 |
| 3,657,027 | 4/1972 | Horsey et al. | 149/19.91 |
| 3,736,194 | 5/1973 | Heller | 149/19.92 |
| 3,932,242 | 1/1976 | Bartley et al. | 149/19.91 |

*Primary Examiner*—Edward A. Miller

*Attorney, Agent, or Firm*—Nathan Edelberg; Kenneth P. Van Wyck

[57] ABSTRACT

An improved method for preparing a "plasticized" red phosphorous smoke agent through the steps comprising mixing particulate red phosphorous with a non-swollen, commercial latex polymer "plasticizer." In the preferred embodiment the latex polymer plasticizer is a butyl rubber.

12 Claims, No Drawings

METHOD FOR PREPARING A SMOKE AGENT

DEDICATORY CLAUSE

The invention described herein may be manufactured, used, and licensed by or for the Government for governmental purposes without the payment to me of any royalty thereon.

DESCRIPTION OF THE INVENTION

This invention relates to an improved method for preparing a "plasticized" i.e., coated red phosphorous smoke agent for filling munitions.

The invention further relates to an improved method for preparing a latex "plasticized" red phosphorous composition.

The invention still further relates to an improved method for preparing a plasticized red phosphorous smoke agent without the use of hazardous strong organic solvents for pre-swelling the polymer plasticizer.

The prior art method for "plasticizing" both red and white phosphorous has been essentially the method disclosed in the U.S. Pat. Nos. 2,574,466 and 2,658,874 to J. P. Clay et al. wherein red phosphorous is plasticized by mixing the phosphorous with various natural or synthetic polymers, e.g., rubber, isobutylmethacrylate polymers or other organic polymers which thicken or gel flammable organic liquids when added thereto in minor proportions. The polymers are pre-swollen in strong organic solvents such as gasoline, toluene or benzene before being added to the phosphorous to effect the desired incorporation. The organic solvents used in the prior methods are extremely hazardous, both in toxicity and high flammability. Thus, only low energy processes can be used with the organic solvent swelled polymer. A further disadvantage of the prior art methods of using polymers swelled by organic solvents is that it takes several days for the polymers to swell to the degree necessary for mixing with the red phosphorous.

It has also been proposed in the art that particulate amorphous red phosphorous be protected from oxidation in moist air by coating the red phosphorous with an elastomer, as in the process disclosed in British Patent Application No. 30134/73 of June 25 1973 by P. J. R. Bryant et al. In the above process, a suitable elastomer such as styrene/butadiene copolymers or butyl rubber is applied to the surface of the particulate stabilizied red phosphorous by conventional coating techniques such as heating the elastomer to make it fluid or dissolving the elastomer in an organic solvent such as a halogenated hydrocarbon and then mixing the "fluid" elastomer with the red phosphorous. The resulting coated red phosphorous is then extruded and then dried. The process thus suffers from the same disadvantages as the other prior art process in that it requires either hazardous organic solvents to swell the elastomer or special preheating and requires substantially prolonged processing time.

The process of the present invention uses commercially manufactured and ready to use latexes as the plasticizer component of "plasticized" red phosphorous, without the need for prior swelling of the "plasticizer" with hazardous organic solvents, preheating, or through use of specialized processing equipment as in the prior art processes. As a result of this invention, "plasticized" i.e., coated red phosphorous can be produced by safer, more rapid and flexible techniques, utilizing a wide variety of higher energy equipment.

The present invention further allows for coating unstabilized red phosphorous, as well as the stabilized red phosphorous used exclusively in the prior art processes.

SUMMARY OF THE INVENTION

An improved method for preparing a "plasticized" i.e., coated red phosphorous smoke agent for use in a munition wherein particulate red phosphorous is coated by mixing the red phosphorous with a polymer plasticizer, the improvement consisting essentially of using a non-swollen, commercial latex polymer as the "plasticizer" for coating the red phosphorous wherein the step of swelling the polymer plasticizer in a strong organic solvent is eliminated.

The principal object of this invention is to provide an improved method for preparing a "plasticized" red phosphorous smoke agent by mixing particulate red phosphorous with a non-swollen, commercially manufactured latex polymer as the "plasticizer" i.e., coating component.

A further object of this invention is to provide an improved method for preparing a plasticized red phosphorous smoke agent through use of a commercially available latex plasticizer which can be mixed with red phosphorous without pre-swelling.

A still further object of this invention is to provide a more rapid, yet safe, and flexible method for plasticizing red phosphorous without the need for hazardous strong organic solvents which are toxic and highly flammable.

These and other objects of this invention will become apparent from the following detailed description of the invention.

In accordance with this invention, a red phosphorous smoke agent is prepared through the process of mixing red phosphorous with a natural or synthetic latex which is ready to use in its commercially manufactured form. The red phosphorous and latex polymer may be mixed in any manner conventionally known in the art. No special low energy equipment is necessary for proper mixing.

The red phosphorous smoke agent manufacturing process of this invention involves mixing 32 to 92 percent red phosphorous with 68 to 8 percent synthetic or natural latex (containing about 63 percent polymer) and up to one percent of a conventional curative/antioxidant. The curative is used to reduce the rate of oxidation of the red phosphorous smoke agent and may be any suitable curative/antioxidant of the type used in latex formulations, such as $PbO_2$ (50% dispersion) and GMF TM (50% dispersion of P-Quinone Dioxime). The curative may be incorporated into the latex solution prior to mixing with the red phosphorous. The mixture thus contains 32 to 76 percent red phosphorous, 5 to 11 percent polymer, 7 to 70 percent water and up to one percent curatives. The mixture is then dried by conventional means, such as air drying or oven drying at 90° to 100° C., to give a mixture containing 75 to 95 percent red phosphorous, 25 to 5 percent polymer plasticizer, and up to one percent curatives. When the mixture is dried to approximately 9.25 percent moisture, it can be extruded through a high energy pellet mill. The pellets are then cured by complete drying either in air overnight or in an oven at 90° to 100° C. for approximately two hours. Curing significantly reduces the sensitivity of the final product to water by essentially cross-linking the polymer coating with the red phosphorous to prevent moisture adsorption by the phosphorous and thus avoid phosphorous degradation to phosphoric acid.

Alternatively, the moisture content of the mixture can be adjusted by selection of the initial water content of the starting components to give the proper moisture content of the mixture for pelleting, i.e., approximately 9.25% for high energy pelleting mills, and thereby eliminate the need for drying before pelleting.

EXAMPLE

Approximately 9080 gm of red phosphorous was initially mixed with a solution of 567 ml distilled water and 44 ml of concentrated $NH_4OH$ (containing 58% $NH_4OH$) in a Hobart blender to give a mixture with a pH of approximately 8.4. The resulting mixture was then mixed with a solution of 765 ml of butyl latex (63% butyl rubber - Exxon 100 butyl latex TM), 38.2 ml of PbO2 (50% dispersion), 19.1 ml of P-quinone dioxime (50% dispersion-GMF TM) and 1.46 ml concentrated $NH_4OH$. The final resulting mixture contained 9.25% moisture. This mixture was then pelletized in a California mill to give a "plasticized" i.e., coated red phosphorous pellet which when oven dried for 2 hours at 90° C., contained 95% red phosphorous and 5% butyl rubber polymer. The product pellet had a density of 1.65 $gm/cm^3$, which gave similarly ignition and burning results to that obtained by prior art processes.

The density of the final pelleted red phosphorous can be varied to obtain the desired burning characteristics, with burning rate increasing with density since the time of burning varies with the surface area of the phosphorous.

The latex used should be slightly basic, i.e., pH 7–10 with a pH of 8–9 being preferred for optimum curing of the red phosphorous pellet product. When the pH is over 10, there are problems encountered in the curing step. The pH should be adjusted by addition of a base, such as $NH_4OH$, to give a pH below 10 when curing is to be used.

The particular latex used in the present invention can be selected from any of the commercially manufactured latex compositions which have been commonly used in the paint industry for the last thirty years, e.g., styrene/-butadiene rubber copolymers.

The curatives/antioxidants can also be selected from any conventional stabilizers used in latex formulation for reducing the rate of oxidation by air or degradation due to the presence of metallic impurities, especially copper.

The mixing operation can be carried out in a wide variety of ways utilizing apparatus conventionally used for mixing latex formulations. The actual time of mixing is relatively rapid but is not critical in itself and can be varied to achieve the desired consistency. Mixing apparatus such as food mixing machines with dough hook mixing blades can be used, but high energy equipment also has utility.

Similarly, the extrusion can be carried out through high energy pellet mills, mincing type machines, and any other conventional venture orifice means or extrusion means commonly used in the art.

The essential feature of this invention is that red phosphorous is plasticized for use in a conventional munition by the rapid and efficient one step process of mixing red phosphorous with a commercial latex which has not been pretreated or pre-swollen with strong organic solvent such as gasoline, benzene, tolene or the like. Thus the present invention eliminates the hazardous and time-consuming prior art step of pre-swelling natural or synthetic polymers of the "plasticizer" component without effecting the overall munition performance.

Applicant having disclosed this invention, obvious modification will be apparent to one skilled in the related chemical and smoke munition art. Applicant therefore wishes to be limited only by the scope of the appended claims.

I claim:

1. A method for preparing a red phosphorous smoke agent wherein particulate red phosphorous is coated with a polymer consisting essentially of the step of mixing particulate red phosphorous with a non-swollen rubber latex selected from the group consisting of natural and synthetic rubber latex.

2. The method of claim 1 wherein the red phosphorous is present in an amount of from 32 to 92 percent and the latex (contains 63% polymer) is present in an amount of from 68 to 8 percent of the mixture.

3. The method of claim 2 further including the step of adding a curative to the red phosphorous and latex mixture.

4. The method of claim 3 wherein the curative is present in an amount of 1 percent of the mixture.

5. The method of claim 4 wherein the mixture is dried to give a red phosphorous smoke agent composition containing 75 to 95 percent red phosphorous, 25 to 5 percent latex polymer and 0 to 1 percent curative.

6. The method of claim 5 wherein the mixture is dried by heating in an oven at 90° to 100° C. for two hours.

7. The method of claim 5 further including the step of extruding the mixture after it has been dried to about 9.0 percent moisture to produce a red phosphorous smoke agent pellet containing 95 percent red phosphorous and 5 percent latex polymer.

8. The method of claim 7 wherein the step of extruding the mixture is performed through use of a high energy pellet mill.

9. The method of claim 7 further including the step of curing the red phosphorous pellet by completely drying said red phosphorous pellet.

10. The method of claim 9 wherein the curing is performed by oven drying at 90° to 100° C. for two hours.

11. The method of claim 5 wherein the latex polymer is butyl rubber.

12. The method of claim 7 wherein the latex polymer plasticizer is butyl rubber.

* * * * *